US009224561B2

(12) United States Patent
Noesner et al.

(10) Patent No.: US 9,224,561 B2
(45) Date of Patent: Dec. 29, 2015

(54) SYSTEMS AND METHODS FOR DELAYING ACTUATION OF A RELAY

(71) Applicant: ABL IP HOLDING LLC, Conyers, GA (US)

(72) Inventors: Kevin Ernest Noesner, Dublin, OH (US); Justin Charles Wilson, Westerville, OH (US); Peter Garais, Westerville, OH (US)

(73) Assignee: ABL IP Holding LLC, Conyers, GA (US)

( * ) Notice: Subject to any disclaimer, the term of this patent is extended or adjusted under 35 U.S.C. 154(b) by 532 days.

(21) Appl. No.: 13/678,001

(22) Filed: Nov. 15, 2012

(65) Prior Publication Data

US 2014/0133061 A1 May 15, 2014

(51) Int. Cl.
*H01H 47/18* (2006.01)
*H01H 9/56* (2006.01)

(52) U.S. Cl.
CPC *H01H 47/18* (2013.01); *H01H 9/56* (2013.01)

(58) Field of Classification Search
CPC ..... H01H 47/18; H01H 9/56
See application file for complete search history.

(56) References Cited

U.S. PATENT DOCUMENTS

| | | | | |
|---|---|---|---|---|
| 4,112,381 | A | 9/1978 | Mortensen et al. | |
| 4,613,791 | A * | 9/1986 | Kurihara et al. | 315/82 |
| 5,055,962 | A | 10/1991 | Peterson et al. | |
| 5,309,068 | A | 5/1994 | Hakkarainen et al. | |
| 5,416,404 | A | 5/1995 | Baldwin | |
| 5,455,469 | A * | 10/1995 | Ward | 307/141.4 |
| 5,530,615 | A | 6/1996 | Miller et al. | |
| 5,804,991 | A | 9/1998 | Hu | |
| 7,672,095 | B2 | 3/2010 | Drake et al. | |
| 8,482,885 | B2 * | 7/2013 | Billingsley et al. | 361/8 |

* cited by examiner

*Primary Examiner* — Zeev V Kitov
(74) *Attorney, Agent, or Firm* — Kilpatrick Townsend & Stockton, LLP

(57) ABSTRACT

A system includes a relay, an actuation circuit, and an actuation delay circuit. The relay is coupled to a source of an input voltage or current waveform. The relay includes an actuation coil. The actuation circuit detects a peak or valley of a rectified voltage ripple waveform. The rectified voltage ripple waveform is generated from the input voltage or current waveform. The actuation circuit also causes an actuation voltage to be provided to the actuation coil. The actuation delay circuit delays the actuation circuit from providing the actuation voltage. The actuation delay circuit is configured based on the peak or valley of the rectified voltage ripple waveform. The actuation delay generated by the actuation delay circuit causes the relay to begin allowing current to flow to a load device at a time coincident with a zero-crossing time value of the input voltage or current waveform.

20 Claims, 10 Drawing Sheets

SYSTEMS AND METHODS FOR DELAYING ACTUATION OF A RELAY

FIELD OF THE INVENTION

The present invention is directed to delaying the actuation of a relay, such as an electromechanical relay.

BACKGROUND

Electrical systems can include devices for switching of electric power, such as a relay. A relay, such as an electromechanical relay, can include one or more contacts for switching power from a power source to a load, such as an electrical device. A relay can be actuated by moving an armature of the relay from a first contact position, such as an open position preventing current from flowing between a power source and a load, to a second contact position, such as a closed position allowing current to flow between a power source and a load. The operational lifespan of a relay can be increased by switching power to a load at a point at which a sinusoidal input voltage or current from a power source has a zero value ("a zero crossing"). Setting a relay to a closed position at or near a point in time associated with the zero crossing of the input line voltage can significantly reduce an inrush current to a reactive load.

Previous solutions for closing a relay at or near a zero crossing time involve zero-cross detection circuits that involve numerous hardware components and/or processing devices executing software algorithms. Such solutions lack methods and/or mechanisms for detecting a maximum value (i.e., peak) or a minimum value (i.e., valley) for a rectified voltage ripple from a power source.

Simplified systems and methods for delaying the actuation of a relay using a peak and/or valley detection mechanism are desirable.

SUMMARY

Aspects of the invention provide systems and methods for delaying actuation of a relay, such as an electromechanical relay.

In one aspect, a system is provided. The system includes a relay, an actuation circuit, and an actuation delay circuit. The relay is coupled to a source of an input voltage or current waveform. The relay includes an actuation coil. The actuation circuit can detect a peak or valley of a rectified voltage ripple waveform. The rectified voltage ripple waveform is generated from the input voltage or current waveform. The actuation circuit can also cause an actuation voltage to be provided to the actuation coil. The actuation delay circuit can delay the actuation circuit from providing the actuation voltage. The actuation delay generated by the actuation delay circuit causes the relay to begin allowing current to flow to a load device at a time coincident with a zero-crossing time value of the input voltage or current waveform. The actuation delay circuit is configured based on the peak or valley of the rectified voltage ripple waveform.

In another aspect, a method is provided. The method involves detecting a peak or a valley of a rectified voltage ripple waveform generated from an input voltage or current waveform provided to a relay. The method further involves determining a time value coincident with a zero-crossing time value of the input voltage or current waveform. The zero-crossing time value is determined based on detecting the peak or the valley of the rectified voltage ripple waveform. The method further involves providing an actuation delay circuit. An actuation delay is generated by the actuation delay circuit. The actuation delay is determined based on a comparator response at a consistent phase angle of the input voltage or current waveform, an actuation duration of the relay, and a duration until the zero-crossing time value of the input voltage or current waveform. The method further involves delaying actuation of the relay by routing an actuation voltage provided to the relay through the actuation delay circuit.

In another aspect, a device is provided for actuating a relay. The relay can be used to provide an input voltage from an input voltage source to a load device. The device includes an actuation circuit and an actuation delay circuit. The actuation circuit can detect a peak or valley of a rectified voltage ripple waveform generated from the input voltage or current waveform. The actuation circuit can provide an actuation voltage or current to the relay. The actuation delay circuit can delay the actuation circuit from providing the actuation voltage or current. An actuation delay generated by the actuation delay circuit is adapted to cause the relay to begin allowing current to flow to the load device at a time coincident with a zero-crossing time value of the waveform of the input voltage or current waveform.

These and other aspects, features and advantages of the present invention may be more clearly understood and appreciated from a review of the following detailed description and by reference to the appended drawings and claims.

DETAILED DESCRIPTION

Figure 1:
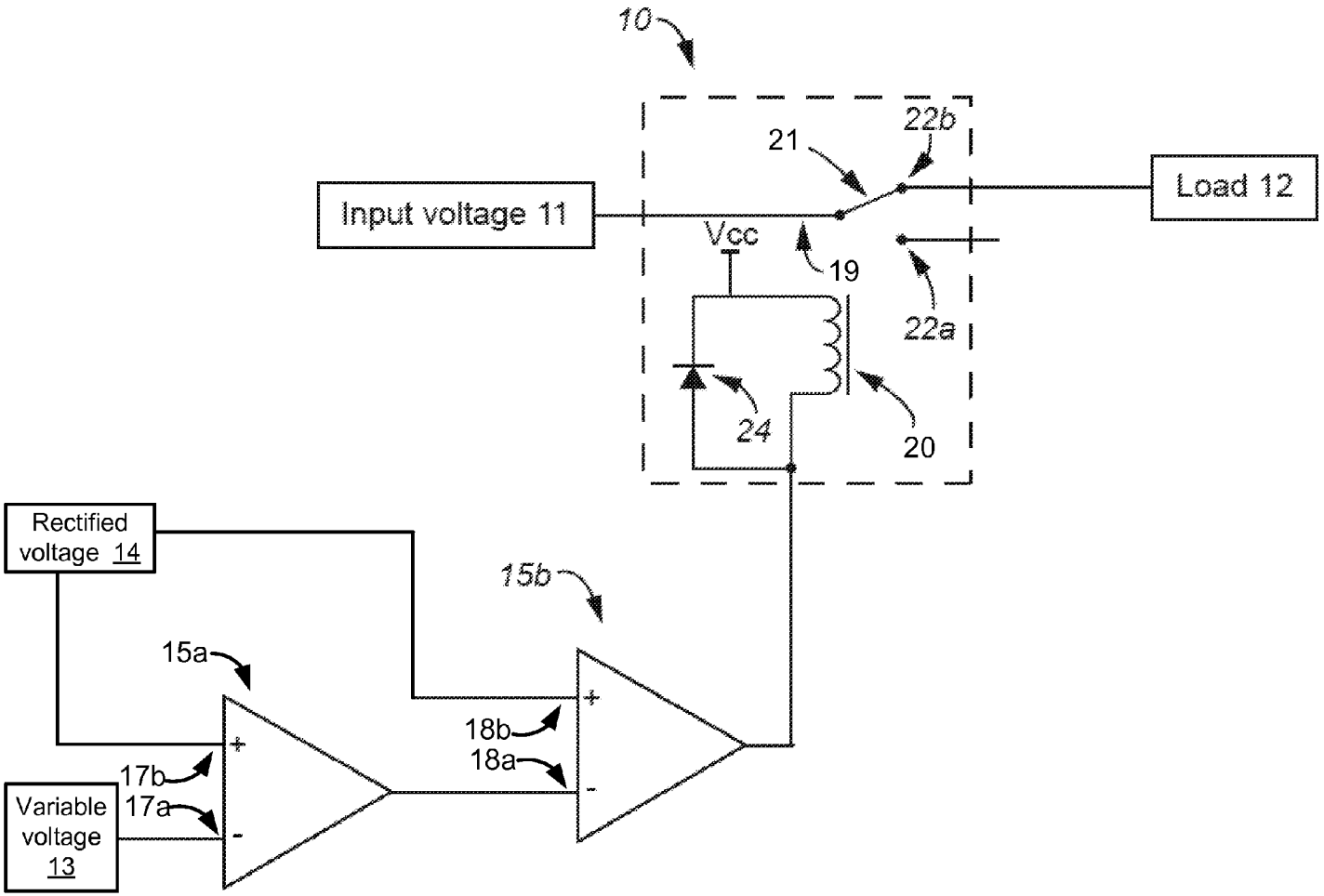
FIG. 1 is a diagram illustrating an example relay for selectively providing a voltage or current to a load device according to one aspect.

Certain aspects of the present invention can delay the actuation of a relay, such as an electromechanical relay.

A system for delaying the actuation of a relay can include a relay, an actuation circuit, and an actuation delay circuit. The relay can be coupled to a source of an input voltage or current waveform. The relay can include an actuation coil. The actuation circuit can provide an actuation voltage or current to the actuation coil. The actuation circuit can detect maximum value (i.e. peak) or minimum value (i.e. valley) of a rectified voltage ripple waveform generated from the input voltage or current waveform. The actuation delay circuit can delay the actuation circuit from providing the actuation voltage or current. An actuation delay generated by the actuation delay circuit is sufficient to cause the relay to begin allowing current to flow to a load device at a time coincident with a zero-crossing time value of the input voltage or current waveform. The actuation delay circuit can be configured based on the peak or valley of the rectified voltage ripple waveform.

In some aspects, the actuation circuit can include a first comparator and a second comparator. The first comparator can include a first input coupled to a variable voltage device and a second input coupled to a rectified voltage device. The variable voltage device can provide a variable voltage at the first input of the first comparator. The rectified voltage device can provide a rectified voltage at the second input of the first comparator. The first comparator can provide an output voltage to the actuation delay circuit in response to the variable voltage exceeding the rectified voltage. The second comparator can include a first input coupled to the actuation delay circuit and a second input coupled to the rectified voltage device. The rectified voltage device can provide the rectified voltage at the second input of the second comparator. The second comparator can provide the actuation voltage at the output of the second comparator in response to the rectified voltage at the second input of the second comparator exceeding a voltage at the first input of the second comparator.

In some aspects, the actuation delay circuit can include a resistor-capacitor network coupled to an input of the second comparator. Configuring the actuation delay circuit based on the peak or valley of the rectified voltage ripple waveform can include selecting the resistance of the resistor and the capacitance of the capacitor based on the actuation duration of the relay and duration until a zero cross of the input voltage. For example, a comparator of the actuation circuit can switch outputs at a minimum value of a rectified voltage that includes a ripple from the rectified voltage device or other rectifier circuit and that is received at one of the inputs of the comparator. The minimum value of the rectified voltage or current corresponds to a consistent phase angle of the input voltage. An actuation delay can be selected based on the repeatable phase angle detection. The actuation delay can be determined from the relay closure time and a duration until a zero-cross of the input voltage. The resistance and the capacitance can be selected such that the product of the resistance and the capacitance provides the actuation delay generated by the actuation delay circuit.

Detailed descriptions of certain embodiment examples are discussed below. These illustrative examples are given to introduce the reader to the general subject matter discussed here and are not intended to limit the scope of the disclosed concepts. The following sections describe various additional embodiment aspects and examples with reference to the drawings in which like numerals indicate like elements, and directional descriptions are used to describe the illustrative embodiment examples but, like the illustrative embodiment examples, should not be used to limit the present invention.

FIG. 1 depicts an example relay 10. The relay 10 can selectively couple an input voltage 11 to a load 12. Non-limiting examples of a load 12 can include lighting devices such as a luminaire using light emitting diodes ("LED"), high-intensity discharge ("HID") lamps, fluorescent lighting sources, and the like. The relay 10 can have an open position in which the input voltage source is not coupled to the load 12 via the relay 10. The relay 10 can have a closed position in which an input voltage 11 is coupled to the load 12 via the relay 10. The input voltage 11 can be a sinusoidal voltage waveform.

The relay 10 can include a switch 19 and an actuation coil 20. The switch 19 can include an armature 21 and contacts 22*a*, 22*b*. Although FIG. 1 depicts the relay 10 as having two contacts 22*a*, 22*b*, a relay 10 can include any number of contacts. The open position of the relay 10 can include the armature 21 being in contact with the contact 22*a*. The closed position of the relay 10 can include the armature 21 being in contact with the contact 22*b*.

The relay 10 can be actuated by an actuation circuit that includes comparators 15*a*, 15*b*. The comparator 15*a* can compare a variable voltage 13 at input 17*a* with a rectified voltage 14 at input 17*b*. The comparator 15*a* can provide an output voltage to the input 18*a* of the comparator 15*b* in response to the variable voltage 13 exceeding the rectified voltage 14. The comparator 15*b* can compare a voltage at input 18*a* with a rectified voltage 14 at input 18*b* The comparator 15*b* can provide an actuation voltage at the output of the comparator 15*b* in response to the voltage at input 18*a* decreasing to a value less than the rectified voltage 14 at input 18*b*. The actuation voltage at the output of the comparator 15*b* can cause a current to flow through the diode 24 and the actuation coil 20 of the relay 10. The current through the actuation coil 20 can provide a magnetic field causing the armature 21 to move from contact 22*a* to contact 22*b*.

The rectified voltage 14 can be a full wave rectified voltage. The rectified voltage 14 can maintain an AC ripple after the rectified voltage 14 is provided to a smoothing circuit. The rectified voltage 14 can be provided by any suitable voltage source or current source, such as a "hot" power line from a power supply. The variable voltage 13 can be a voltage that changes over time or in response to changing conditions. For example, a phototransistor of a load 12, such as a luminaire, cause a variable voltage 13 to be provided to a comparator 15*a* in response to changing light conditions for an area in which the luminaire is positioned.

Figure 2:
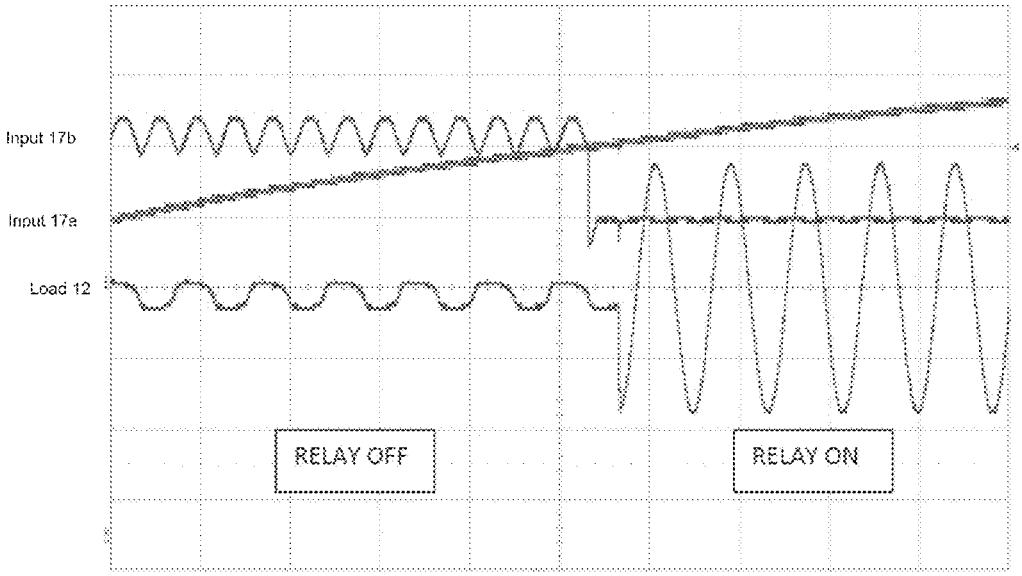
FIG. 2 is a series of graphs illustrating an example relationship between a rectified voltage, a variable voltage, and electrical current provided to a load device through a relay according to one aspect.

FIG. 2 is a graph illustrating the variable voltage 13, the rectified voltage 14, and the current provided to the load 12 for the relay 10 being set to an "OFF" position and an "ON" position. The comparator 15*a* can compare the variable voltage 13 at the input 17*a* to the rectified voltage 14 at the input 17*b*. The voltage at the input 17*a* exceeding the voltage at the input 17*b* can cause the actuation voltage to be provided to the relay 10. Providing the actuation voltage to the relay 10 can cause the armature 21 to close, thereby allowing current to be provided to the load 12. As depicted in FIG. 2, the current provided to the load 12 changes from a value near zero to a sinusoidal waveform. The voltage at the input 17*b* decreases to a hysteresis value less than the intersection value with the voltage at the input 17*a* such that the relay 10 does not fluctuate between an open and closed position.

Figure 3:
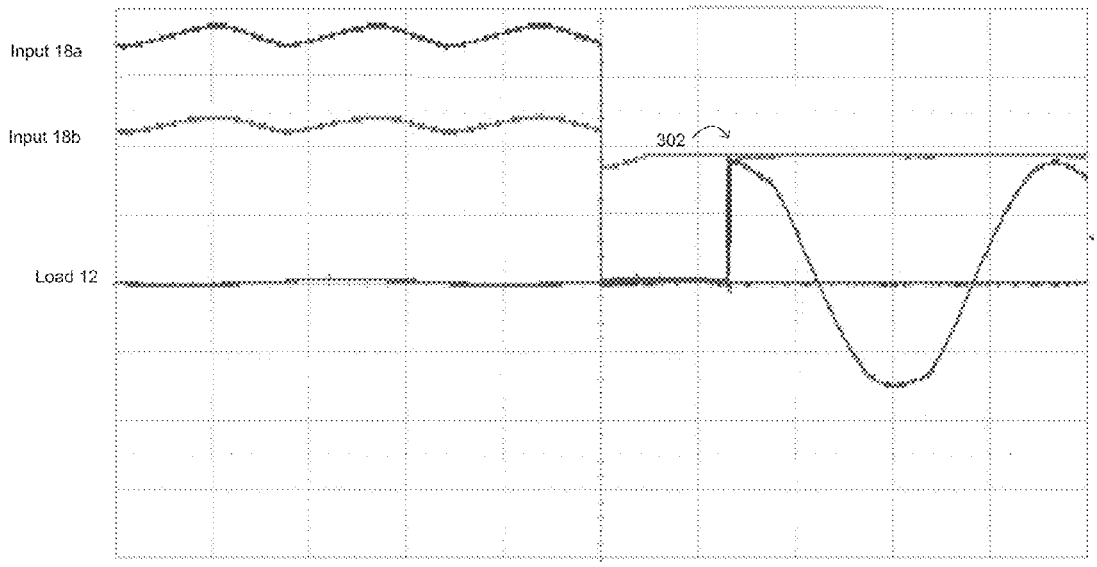
FIG. 3 is a series of graphs illustrating an inrush current provided to a load device through a relay according to one aspect.

A delay can occur between a time at which the actuation voltage causes a current to flow through the actuation coil 20 and a time at which the armature 21 contacts the contact 22*b*. The delay can have a value in a range of a few microseconds to tens of milliseconds. The delay can be the closure time or other actuation duration of the relay 10. The load 12 being coupled to the relay 10 at a peak or other non-zero value of the sinusoidal input voltage 11 can cause an inrush current to flow to the load 12 via the relay 10. For example, FIG. 3 depicts the relay 10 closing at a time 302, as represented by the sudden increase in current through the load 12. The sudden increase in current can be caused by waveform for the input voltage 11 having a maximum value at the time 302. Closing the relay 10 at the time 302 can cause an inrush of current to the load 12 coupled to the relay. An inrush current can provide sufficient energy to cause the contacts 22*a*, 22*b* of the relay 10 to spark, melt, or otherwise experience damage.

Example Operating Environment

Figure 4:
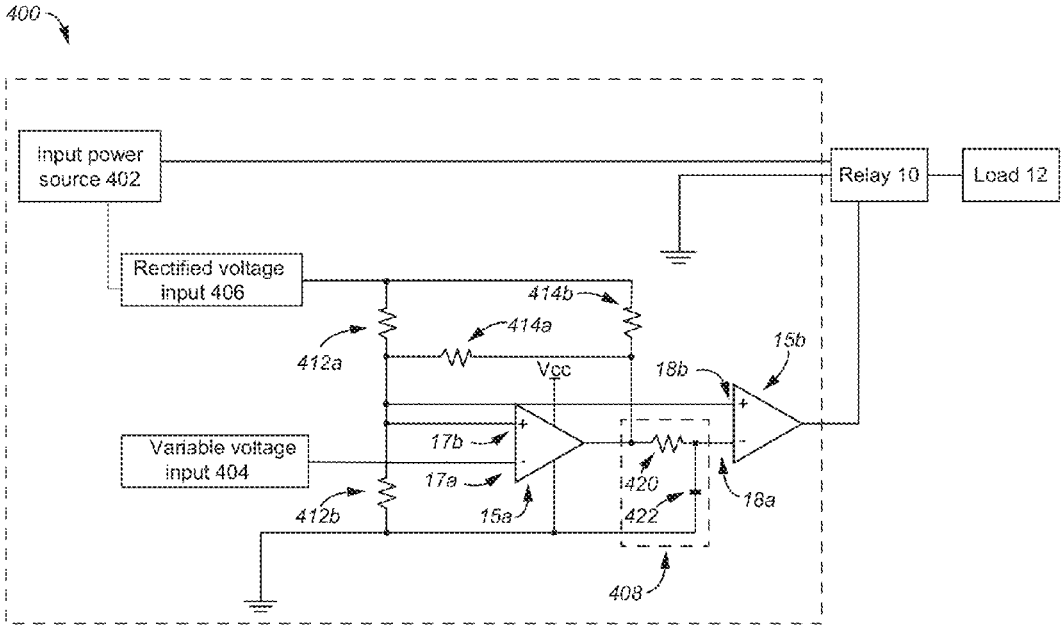
FIG. 4 is a partial schematic diagram illustrating an example system for delaying actuation of a relay according to one aspect.

The inrush current depicted in FIG. 3 can be reduced or eliminated by delaying the actuation of the relay 10. FIG. 4 illustrates an example system 400 for delaying the actuation of an example relay 10. The example system 400 can include an input power source 402, a variable voltage input 404, a rectified voltage input 406, an actuation delay circuit 408, and one or more comparators 15*a*, 15*b*.

The input power source 402 can be any source of power to the load 12 via the relay 10. In some aspects, the rectified voltage input 406 can be any device or group of devices configured modify a voltage or current provided by the input power source 402 to generate a rectified input, such as a rectified power, current, or voltage. In additional or alternative aspects, the rectified voltage input 406 can be a network of zener diodes, capacitors, resistors, and one or more transistors configured to regulate a current or voltage provided by the input power source 402. In other aspects, the rectified voltage input 406 can be a source of a rectified voltage separate from the input power source 402 that is locked with the input power source 402. The rectified voltage can be phase locked with an input voltage, phase locked at the same frequency with the input voltage, or phase locked at a multiple of the same frequency with the input voltage.

The rectified voltage input 406 can be coupled to a voltage divider provided by resistors 412*a*, 412*b*. The rectified voltage input 406 can also be coupled to a hysteresis circuit provided by the resistors 414*a*, 414*b*. The hysteresis circuit provided by the resistors 414*a*, 414*b* can cause the output of the rectified voltage input 406 to be set to a hysteresis value after actuating the relay 10.

The variable voltage input 404 can be any device or group of devices configured to provide a variable voltage to the comparator 15*a* or to cause a variable voltage to be provided to the comparator 15*a*. In some aspects, the variable voltage input 404 can be a device or group of devices that modifies a voltage provided by a separate voltage source. In other aspects, the variable voltage input 404 can be a variable voltage source. A non-limiting example of a variable voltage input 404 is a phototransistor for a load 12 such as a luminaire or other lighting device causing a variable voltage to be provided to the input 17*a* of the comparator 15*a*.

The voltage from the variable voltage input 404 can be provided to an input 17*a* of the comparator 15*a*. The rectified voltage 14 from the rectified voltage input 406 can be provided to an input 17*b* of the comparator 15*a*. The comparator 15*a* can compare the respective voltages at the inputs 17*a*, 17*b* and provide an output voltage to the input 18*a* of the comparator 15*b* in response to the voltage at the input 17*a* exceeding the voltage at the input 17*b*. The comparator 15*a* can provide the output voltage at a point in time corresponding to a maximum or a minimum rectified ripple voltage provided by the rectified voltage input 406.

The output voltage from the comparator 15*a* can be provided to the input 18*a* of the comparator 15*b* via the actuation delay circuit 408. The rectified voltage 14 from rectified voltage input 406 can be provided to input 18*b* of the comparator 15*b*.

The actuation delay circuit 408 can include a resistor 420 and a capacitor 422. The resistance of the resistor 420 and the capacitance of the capacitor 422 can be selected such that the actuation of the relay 10 is delayed. The capacitor 422 of the actuation delay circuit 408 can discharge as a voltage is removed from the input 18*a* from the output of the comparator 15*a*. The voltage provided to the input 18*b* of the comparator 15*b* from the rectified voltage input 406 can be less than the voltage at the input 18*a* of the comparator 15*b* before the discharging of the capacitor 422. The discharging of the capacitor 422 can thus delay the comparator 15*b* from causing an actuation voltage or current to be provided to the relay 10. The duration of the delay can be the discharging duration of the capacitor 422. The actuation of the relay 10 can be sufficiently delayed by the actuation delay circuit 408 such that relay 10 is set to an "ON" position at a point in time at which the sinusoidal input voltage 11 has a zero or near-zero value.

For example, a 60 HZ input voltage waveform may have a 16 milliseconds period. A minimum voltage value (i.e. valley) can thus occur 4 milliseconds before a first zero-cross time value, 8 milliseconds before a maximum voltage value (i.e. peak), and 12 milliseconds before a second zero-cross time value. A closure time or other actuation duration for a relay 10 can be, for example, 8 milliseconds. The relay 10 can be actuated by providing an actuation voltage to the actuation coil 20. Providing an actuation voltage to the actuation coil 20 at a time coincident with a valley of the waveform for the input voltage 11 can cause the relay 10 to close at a time coincident with a peak of the waveform for the input voltage 11. Using the actuation delay circuit 408 to delay actuation of the relay 10 by an additional 4 milliseconds can cause the relay 10 to close at a time coincident with the waveform for the input voltage 11 having a value at or near zero.

Figure 5:
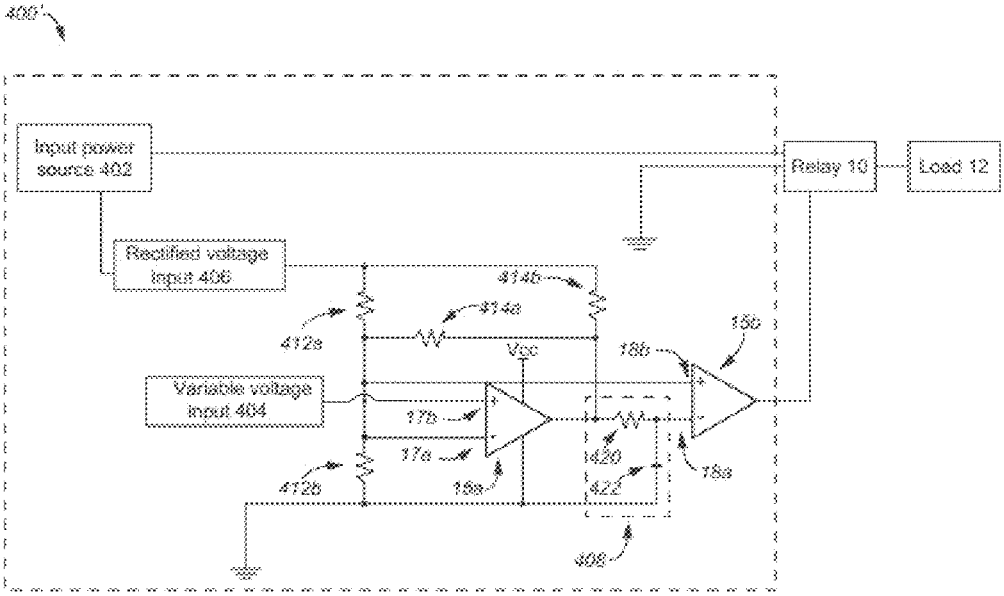
FIG. 5 is a partial schematic diagram illustrating an alternative example system for delaying actuation of a relay according to one aspect.

FIG. 5 is a partial schematic diagram illustrating an alternative example system 400' for delaying actuation of a relay 10. The voltages at the inputs 17*a*, 17*b* of the comparator 15*a* in FIG. 5 are swapped as compared to the system 400 depicted in FIG. 4. The rectified voltage ripple waveform can be provided to the input 17*a* of the comparator 15*a*. The voltage from the variable voltage input 404 can be provided to an input 17*b* of the comparator 15*a*. The comparator 15*a* can compare the respective voltages at the inputs 17*a*, 17*b* and provide an output voltage to the input 18*a* of the comparator 15*b* in response to the voltage at the input 17*b* exceeding the voltage at the input 17*a*.

Figure 6:
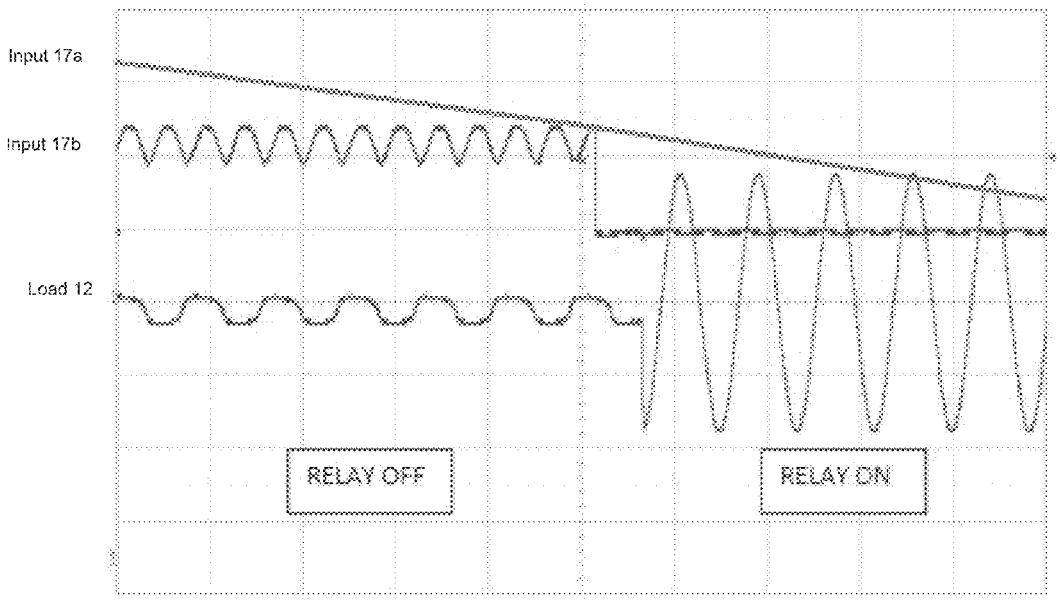
FIG. 6 is a series of graphs illustrating an example relationship between a rectified voltage, a variable voltage, and electrical current provided to a load device for the alternative example system according to one aspect.

FIG. 6 is a graph illustrating the voltages at the inputs 17*a*, 17*b* and the current provided to the load 12 for the relay 10 being set to an "OFF" position and an "ON" position. The comparator 15*a* can compare the variable voltage at the input 17*a* to the rectified voltage ripple at the input 17*b*. The rectified voltage ripple at the input 17*b* exceeding the variable voltage at the input 17*a* can cause an actuation voltage to be provided to the relay 10.

Although FIGS. 4-5 depict an actuation delay circuit 408 that is positioned between two comparators 15*a*, 15*b*, other implementations are possible. In additional or alternative aspects, a system for actuating the relay 10 can include a single comparator. An actuation delay circuit 408 can be positioned at the output of the single comparator that delays the actuation of the relay coil 20.

The actuation delay circuit 408 can be configured by selecting the resistor 420 and/or the capacitor 422 based on the peak or valley of the rectified voltage 14. For example, the comparator 15*a* can switch outputs at a minimum value of a rectified voltage or current, such as the rectified voltage 14. The minimum value of the rectified voltage 14 corresponds to a consistent phase angle of the input voltage 11. An actuation delay for the actuation delay circuit 408 can be selected based on the relay closure time (i.e., actuation duration) of the relay 10 and duration until a zero cross of the input voltage.

The duration of the delay provided by the actuation delay circuit 408 can be determined based on detecting a maximum value (i.e. peak) or minimum value (i.e. valley) for the rectified voltage ripple waveform and using a closure time or other actuation duration for the relay 10. The closure time for the relay 10 can be predetermined based on the type of relay. The frequency of the input voltage waveform can also be predetermined. For example, the rectified voltage input 406 can modify the input voltage 11 to output a full wave rectified power waveform for the rectified voltage 14. The waveform for the rectified voltage 14 at the input 17*a* of the comparator 15*a* can have a ripple that is twice the frequency as the waveform for the input voltage 11.

The waveforms for the input voltage 11 and the rectified voltage 14 can correspond to one another so as to provide a single, repeatable delay for aligning closure of the relay 10 to a zero-cross time for the input voltage. The comparator 15*a* can cause an actuation voltage or current to be provided to the relay 10 at a time coincident with the minimum value of the rectified voltage 14 and a consistent phase angle for the input voltage 11.

Figure 7:
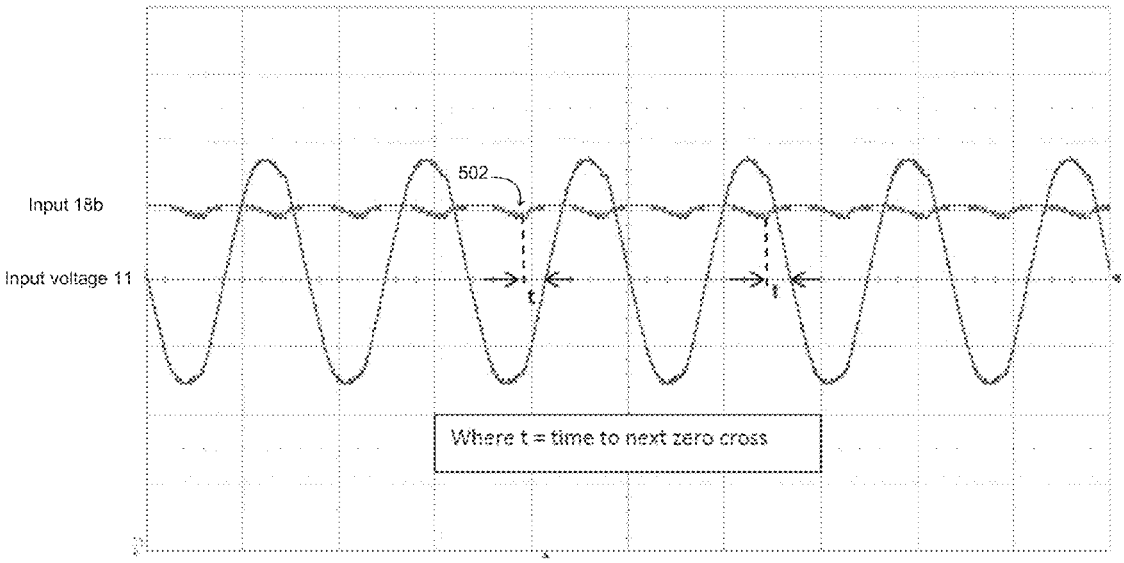
FIG. 7 is a graph illustrating an example relationship between a rectified voltage ripple waveform and an input voltage waveform that can be used to determine a zero-crossing time value according to one aspect.

For example, as depicted in FIG. 7, the comparator 15*a* can activate at an activation time 502. The activation can occur at a minimum value of rectified voltage 14. The minimum value of the rectified voltage 14 corresponds to a consistent phase angle for the input voltage 11 given a fixed frequency. The phase of the rectified voltage 14 at the input 18*b* and the input voltage 11 are locked. The time t thus remains constant.

A given relay can have a predetermined closure time. The closure time can be determined via a tool for measuring current, voltage, or power provided via the relay.

Figure 8:
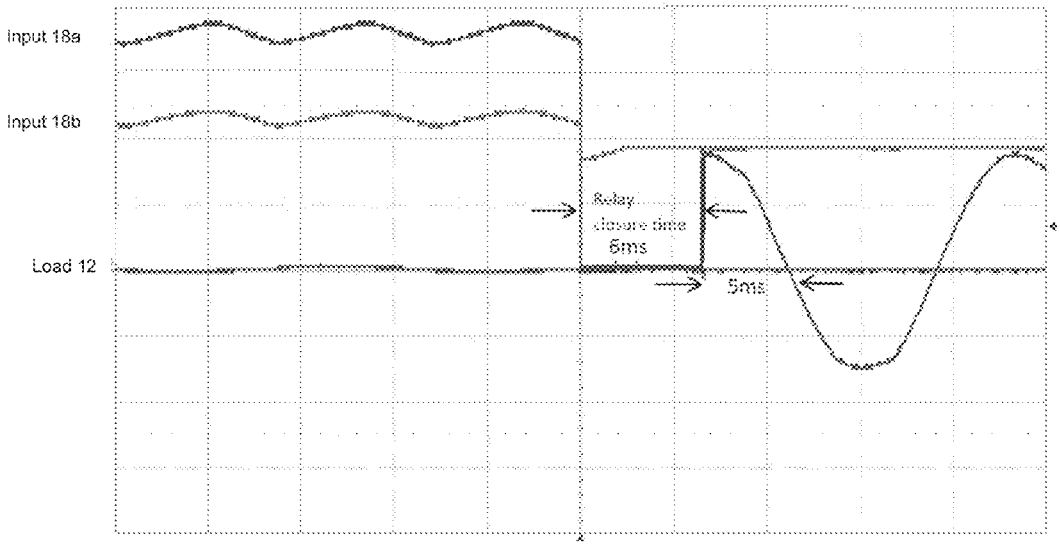
FIG. 8 is a graph illustrating an example relationship between input voltages to a second comparator and a current through a load that can be used to determine an actuation delay for a relay according to one aspect.
Figure 9:
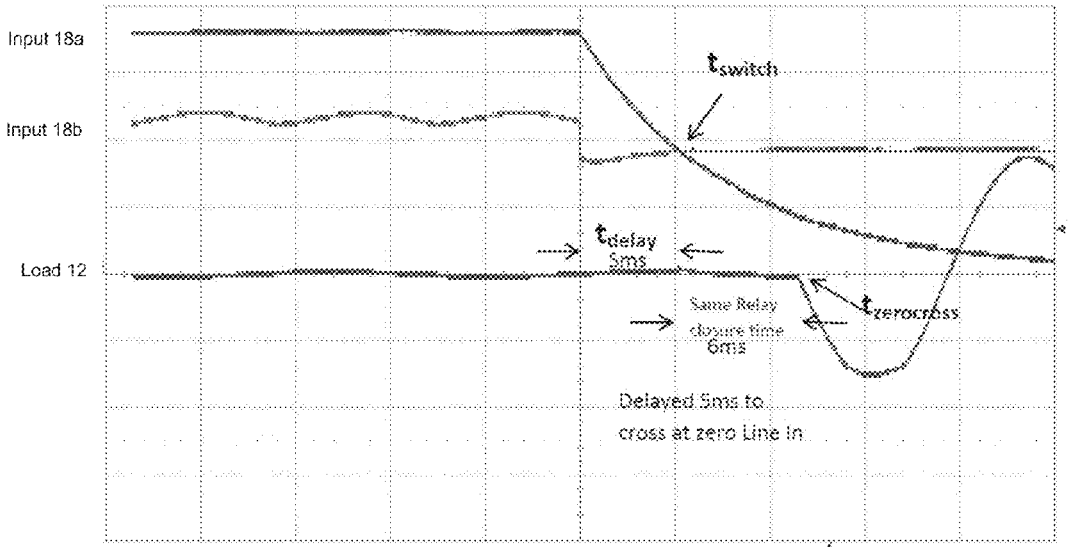
FIG. 9 is a graph illustrating an example relationship between input voltages to a second comparator and a current through a load including an actuation delay for a relay according to one aspect.

For example, as depicted in FIG. 8, a relay 10 can have a closure time of 6 milliseconds. The duration between a point in time at which the relay 10 is switched or otherwise actuated and a zero or near-zero value of the input voltage 11 can be 5 milliseconds. The resistance of the resistor 420 and the capacitance of the capacitor 422 can be selected such that the actuation of the relay 10 is delayed by 5 milliseconds. Delaying the actuation of the relay 10 by 5 milliseconds can cause the relay 10 to be closed at time in which the input voltage 11 is at a zero or near zero value. Closing the relay 10 at time coincident with the input voltage 11 having a zero or near zero value can minimize or reduce the current inrush to the load 12 via the relay 10, as depicted in FIG. 9.

The resistance of the resistor 420 and the capacitance of the capacitor 422 can be determined based on a desired delay corresponding to the actuation duration and an activation time 502. For example, a desired delay of $t_{delay}$ can be 5 milliseconds. An activation time 502 can be determined based on a voltage at input 18*b* of the comparator 15*b* having a value that is 50% of the rectified voltage input 406.

Figure 10:
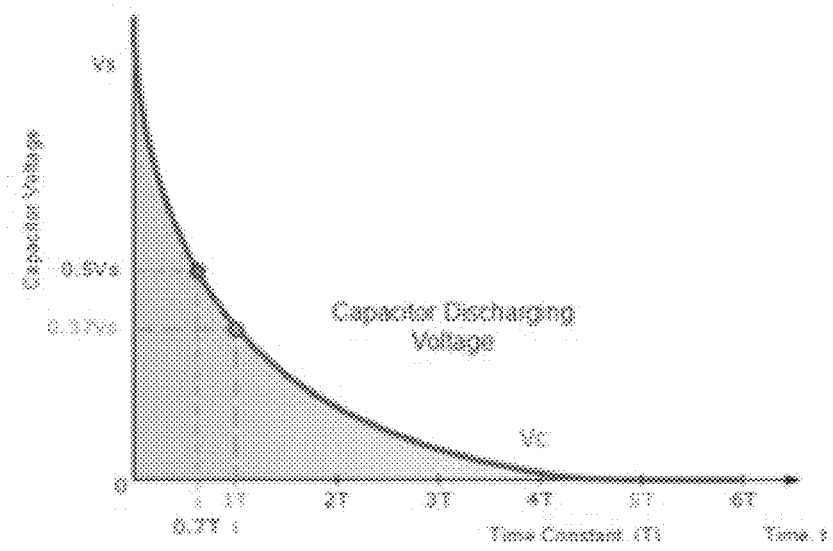
FIG. 10 is a graph depicting the rate of discharge for a capacitor in an actuation delay circuit according to one aspect.

As depicted in FIG. 10, a 50% voltage drop can occur at time $0.7\times\tau$, where $\tau$ is determined by the equation $\tau=RC$, and R is the resistance of the resistor 420 and C is the capacitance of the capacitor 422. The relay coil 20 can receive an actuation current for actuating the relay 10 in response to the voltage at input 18*a* decreasing by 50% (e.g., from 19 V to 9.5 V). A voltage drop of 50% at 5 milliseconds can cause the relay 10 to close at a zero-cross time value for the input voltage 11. Thus, $0.7\tau$ is 5 milliseconds and $\tau$ is 0.0071428. The resistance of the resistor 420 and the capacitance of the capacitor 422 can be selected such that the value of $RC=\tau$ is 0.0071428. For example, a capacitor 422 having a capacitance of 0.1 microfarads and a resistor 420 having a resistance of 71,428 Ohms can be used.

In additional or alternative aspects, an electronic device including multiple relays can be manufactured. Each relay of the electronic device can be analyzed to determine a respective closure time or other actuation duration for the relay. A suggested resistor value for a respective actuation delay circuit for each relay can be generated based on the respective closure time or other actuation duration for the relay.

For example, a calibration test device can be used to determine a desired RC value. A pre-determined capacitor value (such as a standard capacitor value) for the capacitor 422 of an actuation delay circuit 408 can be populated on a printed circuit board used to implement the system 400. A resistance value for the resistor 420 can be omitted from the printed circuit board used to implement the system 400. A suitable mechanism can be used short-circuit the resistor 420. A non-limiting example of a suitable mechanism for shorting the resistor 420 is a bed of nails. The relay 10 can be actuated by changing a reference voltage on comparator 15*a*. Changing the reference voltage can include, for example, changing the light level.

The calibration test device can compare an input line voltage with a relay output voltage. The calibration test device can detect the relay output voltage. The calibration test device can determine a phase of the cycle of the transition. The calibration test device can calculate a desired delay to achieve zero cross. The calibration test device can determine a resistance value for the resistor 420 based on the desired delay and the populated capacitance value for the capacitor 422. The resistance value R for a capacitance value C can be determined from the formula R=Delay×C, wherein the delay is measured in seconds. The determined resistance value R can be communicated to an operator on a production line for populating the resistance value for the resistor 420 on a circuit board.

The foregoing description, including illustrated examples, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention. Aspects and features from each example disclosed can be combined with any other example.

What is claimed is:

1. A system comprising:

a relay having an actuation coil, the relay coupled to a source of an input voltage or current waveform;

an actuation circuit configured to detect a peak or valley of a rectified voltage ripple waveform generated from the input voltage or current waveform and to cause an actuation voltage to be provided to the actuation coil, the actuation circuit comprising:

a first comparator configured to:

receive a variable voltage and the rectified voltage ripple waveform, the rectified voltage ripple waveform including a ripple voltage that is phase locked with the input voltage or current waveform, and provide an output voltage to the actuation delay circuit in response to the variable voltage having a value above the ripple voltage at the peak of the rectified voltage ripple waveform or below the ripple voltage at the valley of the rectified voltage ripple waveform, and a second comparator configured to:

receive the rectified voltage ripple waveform and an additional input voltage corresponding to the output voltage from the first comparator, and provide the actuation voltage in response to the additional input voltage decreasing to a value below the rectified voltage ripple waveform; and an actuation delay circuit configured to delay the actuation circuit from providing the actuation voltage, wherein an actuation delay generated by the actuation delay circuit is adapted to cause the relay to begin allowing current to flow to a load device at a time coincident with a zero-crossing time value of the input voltage or current waveform, wherein the actuation delay circuit is configured based on the peak or valley of the rectified voltage ripple waveform.

2. The system of claim 1, wherein the first comparator comprises:

a first input coupled to a variable voltage device, the variable voltage device configured to provide the variable voltage at the first input, and a second input coupled to a rectified voltage device, the rectified voltage device configured to provide the rectified voltage ripple waveform, wherein the first comparator is further configured to provide the output voltage to the actuation delay circuit in response to the variable voltage increasing to the value exceeding the ripple voltage at the peak of the rectified voltage ripple waveform corresponding to a consistent phase angle of the input voltage or current waveform; and wherein the second comparator comprises:

a first additional input coupled to the actuation delay circuit and configured to receive the additional input voltage, and a second additional input coupled to the rectified voltage device, the rectified voltage device configured to provide the rectified voltage ripple waveform at the second additional input.

3. The system of claim 2, wherein the actuation delay circuit comprises an resistor-capacitor network coupled to an output of the first comparator and configured to provide the additional input voltage at the first additional input of the second comparator, the resistor-capacitor network comprising a resistor having a resistance and a capacitor having a capacitance, wherein the resistance of the resistor and the capacitance of the capacitor have been selected based on an actuation duration of the relay and a duration until the zero-crossing time value of the input voltage or current waveform.

4. The system of claim 3, wherein the product of the resistance and the capacitance is proportionate to the actuation delay generated by the actuation delay circuit.

5. The system of claim 2, wherein the load device comprises a lighting device and the variable voltage device comprises a light sensing device.

6. The system of claim 1, wherein the first comparator comprises:

a first input coupled to a variable voltage device, the variable voltage device configured to provide the variable voltage at the first input, and a second input coupled to a rectified voltage device, the rectified voltage device configured to provide the rectified voltage ripple waveform, wherein the first comparator is configured to provide the output voltage to the actuation delay circuit in response to the variable voltage decreasing to a value below the ripple voltage at the valley of the rectified voltage ripple waveform corresponding to a consistent phase angle of the input voltage or current waveform; and wherein the second comparator comprises:

a first additional input coupled to the actuation delay circuit and configured to receive the additional input voltage, and a second additional input coupled to the rectified voltage device, the rectified voltage device configured to provide the rectified voltage ripple waveform at the second additional input.

7. A method comprising:

detecting a peak or a valley of a rectified voltage ripple waveform generated from an input voltage or current waveform provided to a relay;

determining a time value coincident with a zero-crossing time value of the input voltage or current waveform based on detecting the peak or the valley of the rectified voltage ripple waveform;

providing an actuation delay circuit, wherein an actuation delay generated by the actuation delay circuit is determined based on a comparator response at a consistent phase angle of the input voltage or current waveform, an actuation duration of the relay, and a duration until the zero-crossing time value of the input voltage or current waveform;

delaying actuation of the relay by routing an actuation voltage provided to the relay through the actuation delay circuit; and actuating the relay with an actuation circuit comprising:

a first comparator that (i) receives a variable voltage and the rectified voltage ripple waveform, the rectified voltage ripple waveform including a ripple voltage that is phase locked with the input voltage or current waveform and (ii) provides an output voltage to the actuation delay circuit in response to the variable voltage having a value above the ripple voltage at the peak of the rectified voltage ripple waveform or below the ripple voltage at the valley of the rectified voltage ripple waveform, and a second comparator that (i) receives the rectified voltage ripple waveform and an additional input voltage corresponding to the output voltage from the first comparator and (ii) provides the actuation voltage to the relay in response to the additional input voltage decreasing to a value below the rectified voltage ripple waveform.

8. The method of claim 7, wherein the consistent phase angle of the input voltage or current waveform is detected based on the ripple of the rectified voltage ripple waveform.

9. The method of claim 7, wherein the actuation delay circuit comprises a resistor-capacitor network, the resistor-capacitor network comprising a resistor having a resistance and a capacitor having a capacitance, wherein the resistance of the resistor and the capacitance of the capacitor are selected based on the comparator response, the actuation duration of the relay, and the duration until the zero-crossing time value.

10. The method of claim 7, wherein the first comparator comprises:

a first input coupled to a variable voltage device that provides the variable voltage at the first input, and a second input coupled to a rectified voltage device that provides the rectified voltage ripple waveform, wherein the first comparator provides the output voltage to the actuation delay circuit in response to the variable voltage increasing to a value exceeding the ripple voltage at the peak of the rectified voltage ripple waveform corresponding to the consistent phase angle of the input voltage or current waveform; and wherein the second comparator comprises:

a first additional input that is coupled to the actuation delay circuit and that receives the additional input voltage, and a second additional input coupled to the rectified voltage device that provides the rectified voltage ripple waveform at the second additional input.

11. The method of claim 10, wherein the peak or valley of the rectified voltage ripple waveform is detected using the first comparator.

12. The method of claim 10, wherein the actuation delay circuit comprises a resistor-capacitor network that is coupled to an output of the first comparator and that provides the additional input voltage at the first additional input of the second comparator.

13. The method of claim 12, wherein the resistor-capacitor network comprises a resistor having a resistance and a capacitor having a capacitance, wherein the actuation delay generated by the actuation delay circuit is a function of the product of the resistance and the capacitance.

14. The method of claim 7, wherein the first comparator comprises comprising:

a first input coupled to a variable voltage device that provides the variable voltage at the first input, and a second input coupled to a rectified voltage device that provides the rectified voltage ripple waveform wherein the first comparator provides the output voltage to the actuation delay circuit in response to the variable voltage decreasing to a value below the ripple voltage at the peak or valley of the rectified voltage ripple waveform corresponding to the consistent phase angle of the input voltage or current waveform; and wherein the second comparator comprises:

a first additional input that is coupled to the actuation delay circuit and that receives the additional input voltage, and a second additional input coupled to the rectified voltage device that provides the rectified voltage ripple waveform at the second additional input.

15. A device for actuating a relay configured to provide an input voltage from an input voltage source to a load device, the device comprising:

an actuation circuit configured to detect a peak or valley of a rectified voltage ripple waveform generated from the input voltage or current waveform and to provide an actuation voltage or current to the relay; and an actuation delay circuit configured to delay the actuation circuit from providing the actuation voltage or current, wherein an actuation delay generated by the actuation delay circuit is adapted to cause the relay to begin allowing current to flow to the load device at a time coincident with a zero-crossing time value of the waveform of the input voltage or current waveform wherein, the actuation circuit comprises:

a first comparator configured to:

receive a variable voltage and the rectified voltage ripple waveform, the rectified voltage ripple waveform including a ripple voltage that is phase locked with the input voltage or current waveform, and provide an output voltage to the actuation delay circuit in response to the variable voltage having a value above the ripple voltage at the peak of the rectified voltage ripple waveform or below the ripple voltage at the valley of the rectified voltage ripple waveform, and a second comparator configured to:

receive the rectified voltage ripple waveform and an additional input voltage corresponding to the output voltage from the first comparator, and provide the actuation voltage in response to the additional input voltage decreasing to a value below the rectified voltage ripple waveform.

16. The device of claim 15, wherein the first comparator comprises:

a first input coupled to a variable voltage device, the variable voltage device configured to provide the variable voltage at the first input, and a second input coupled to a rectified voltage device, the rectified voltage device configured to provide the rectified voltage ripple waveform, wherein the first comparator is further configured to provide the output voltage to the actuation delay circuit in response to the variable voltage increasing to the value exceeding the ripple voltage at the peak of the rectified voltage ripple waveform corresponding to a consistent phase angle of the input voltage or current waveform; and wherein the second comparator comprises:

a first additional input coupled to the actuation delay circuit and configured to receive the additional input voltage, and a second additional input coupled to the rectified voltage device, the rectified voltage device configured to provide the rectified voltage ripple waveform at the second additional input.

17. The device of claim 16, wherein the actuation delay circuit comprises a resistor-capacitor network coupled to an output of the first comparator and configured to provide the additional input voltage at the first additional input of the second comparator, the resistor-capacitor network comprising a resistor having a resistance and a capacitor having a capacitance, wherein the resistance of the resistor and the capacitance of the capacitor have been selected based on a comparator response at the consistent phase angle of the input voltage, duration until a zero cross, and an actuation duration of the relay.

18. The device of claim 17, wherein the product of the resistance and the capacitance is proportionate to the actuation delay generated by the actuation delay circuit.

19. The device of claim 16, wherein the load device comprises a lighting device and the variable voltage device comprises a light sensing device.

20. The device of claim 15, wherein the first comparator comprises:

a first input coupled to a variable voltage device, the variable voltage device configured to provide the variable voltage at the first input, and a second input coupled to a rectified voltage device, the rectified voltage device configured to provide the rectified voltage ripple waveform, wherein the first comparator is configured to provide the output voltage to the actuation delay circuit in response to the variable voltage decreasing to a value below the ripple voltage at the valley of the rectified voltage ripple waveform corresponding to a consistent phase angle of the input voltage or current waveform; and wherein the second comparator comprises:

a first additional input coupled to the actuation delay circuit and configured to receive the additional input voltage, and a second additional input coupled to the rectified voltage device, the rectified voltage device configured to provide the rectified voltage ripple waveform at the second additional input.

* * * * *